US006290585B1

(12) United States Patent
Nakamura

(10) Patent No.: US 6,290,585 B1
(45) Date of Patent: Sep. 18, 2001

(54) POLISHING MACHINE

(75) Inventor: Yoshio Nakamura, Nagano (JP)

(73) Assignee: Fujikoshi Kikai Kogyo Kabushiki Kaisha, Nagano (JP)

( * ) Notice: Subject to any disclaimer, the term of this patent is extended or adjusted under 35 U.S.C. 154(b) by 0 days.

(21) Appl. No.: 09/510,760

(22) Filed: Feb. 22, 2000

(30) Foreign Application Priority Data

Feb. 26, 1999 (JP) ..... 11-050095

(51) Int. Cl.[7] ..... B24B 5/00; B24B 29/00
(52) U.S. Cl. ..... 451/288; 451/398
(58) Field of Search ..... 451/41, 5, 28, 451/63, 285, 287, 288, 289, 259, 268, 269, 270, 397, 398, 364, 360

(56) References Cited

U.S. PATENT DOCUMENTS 5,558,568 * 9/1996 Talieh et al. ..... 451/303
6,086,456 * 7/2000 Weldon et al. ..... 451/41
6,111,634 * 8/2000 Pecen et al. ..... 356/72
6,132,295 * 10/2000 Tietz et al. ..... 451/41

FOREIGN PATENT DOCUMENTS 9123058 5/1997 (JP) .
9267258 10/1997 (JP) .

* cited by examiner

*Primary Examiner*—Derris H. Banks
(74) *Attorney, Agent, or Firm*—Jordan and Hamburg LLP

(57) ABSTRACT

The polishing machine is capable of preventing fine vibrations of a polishing face of a polishing plate. In the polishing machine, a plate holder is rotatably provided to a base. The polishing plate is mounted on the plate holder, and an upper face of the polishing plate is covered with a polishing cloth as the polishing face. A press unit presses a surface of a work piece onto the polishing face of the polishing plate so as to polish the surface of the work piece like a mirror face. A fluid bearing rotatably supports the plate holder by fluid pressure, at a position between the plate holder and the base, so as to keep the polishing face of the polishing plate flat.

10 Claims, 7 Drawing Sheets

POLISHING MACHINE

BACKGROUND OF THE INVENTION

The present invention relates to a polishing machine, more precisely relates to a polishing machine having: a plate holder rotatably provided to a base; a polishing plate, whose upper face is covered with a polishing cloth as a polishing face, mounted on the plate holder; and a press unit for pressing a surface of a work piece onto the polishing face so as to polish the surface of the work piece like a mirror face.

A conventional polishing machine for polishing surfaces of silicon wafers, etc. is shown in FIG. 9. In the polishing machine, a plurality of silicon wafers, etc. are simultaneously polished like mirror faces. An upper face of a polishing plate, which is rotated in a direction of an arrow A, is covered with a polishing cloth 108. A plurality of press units 110, which are provided above the polishing clothe 108, are respectively rotated in directions of arrows B. Each of the press units 110 presses the silicon wafer onto the polishing cloth 108 so as to polish the silicon wafer.

A partial sectional view of the polishing machine shown in FIG. 9 is shown in FIG. 10. As shown in FIG. 10, a plate holder 104 is rotatably provided in a base 100. The plate holder is rotated, together with a rotary shaft in the direction A, by a motor (not shown). A polishing plate 106 is mounted on the plate holder 104. As described above, the polishing cloth 108 is fixed on an upper face of the polishing plate so as to form the polishing face.

The press unit 110 is provided above the polishing plate 106 and covers an outer edge part thereof. The press unit 110 presses work pieces 105, e.g., the silicon wafers, onto the polishing face of the polishing plate 106. The work pieces 105 are adhered on a lower face of the press unit 110, which faces the polishing face of the polishing plate 106.

Lower surfaces of the work pieces 105 are polished by the polishing cloth 108 with slurry, which is supplied by a pipe 107.

Weight of the polishing plate 106 and pressing force of the press unit 110 are applied to an outer edge part of the plate holder 104, so the outer edge part of the plate holder 104 is downwardly deformed with respect to a center part thereof, which is connected to the rotary shaft 102. Thus, it is difficult to keep the polishing face of the polishing plate 106 flat. Thus, in the conventional polishing machine, a ball bearing 112 is provided between the outer edge part of the plate holder 104 and the base 100.

As shown in FIG. 10, by providing the ball bearing 112 between the outer edge part of the plate holder 104 and the base 100, the plate holder 104 is capable of rotating and keeping the polishing face of the polishing plate 106 flat even if the weight of the polishing plate 106 and the pressing force of the press unit 110 are applied to the outer edge part of the plate holder 104.

However, balls of the ball bearings 112 are not true spheres and have minute errors in size. The errors can be reduced but cannot be zero. Therefore, the plate holder 104, which is supported by the ball bearing 112, is moved on the balls of the bearing 112, which rotate with the movement of the plate holder 104, so that fine vibrations of the plate holder 104, which are caused by the minute errors, are occurred. The fine vibrations of the plate holder 104 makes fine projections like ripples on the polished surfaces of the work pieces 105, so that flatness of the work pieces cannot be improved.

Generally, the polishing step is a final step, so the work pieces, which have been polished by the polishing machine, are forwarded. However, in the case of the silicon wafers for semiconductor devices, the flatness of the polished surfaces must be higher, so the work pieces whose surfaces have fine ripple-shaped projections badly influence to final products.

SUMMARY OF THE INVENTION

An object of the present invention is to provide a polishing machine capable of preventing the fine vibrations of a polishing face of a polishing plate, which are caused by rotation of the polishing plate.

The inventor of the present invention studied to achieve the object and found that a fluid bearing could effectively employed instead of the ball bearing.

Namely, the polishing machine of the present invention comprises:

- a plate holder being rotatably provided to a base;
- a polishing plate being mounted on the plate holder, an upper face of the polishing plate being covered with a polishing cloth as a polishing face; and
- a press unit for pressing a surface of a work piece onto the polishing face of the polishing plate so as to polish the surface of the work piece like a mirror face, characterized by,

- a fluid bearing rotatably supporting the plate holder by fluid pressure, at a position between the plate holder and the base, so as to keep the polishing face of the polishing plate flat.

In the polishing machine, the fluid bearing may be a static fluid bearing, which rotatably supports the plate holder by the pressure of the fluid, which is jetted from a plurality of jet nozzles formed in the base. With this structure, the plate holder can be rotatably supported by the fluid pressure while the plate holder is stopped.

In the polishing machine, the fluid bearing may be a dynamic fluid bearing including:

- a circular groove being formed in the base, the circular groove holding the fluid, an inner bottom face of the circular groove being formed into a flat face; and
- a circular projection being downwardly projected from the plate holder, a lower end section of the circular projection being inserted in the circular groove,
- whereby dynamic pressure for rotatably supporting the plate holder is applied to the lower end section of the circular projection when the plate holder is rotated. With this structure, the dynamic fluid bearing has the simple structure and maintenance can be easier.

In the polishing machine of the present invention, the fluid bearing rotatably can support the plate holder by the fluid pressure, at the position between the plate holder and the base, so as to keep the polishing face of the polishing plate flat. Since the weight of the plate holder, etc. can be supported by the fluid pressure, the fine vibrations, which are caused by balls in a ball bearing, are not occurred. Therefore, the work piece can be highly precisely polished like a mirror.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

In the polishing machine of the present invention, it is import and to rotatably, support a plate holder, by fluid pressure of a fluid bearing, at a position between the plate holder and a base and to keep the polishing face of the polishing plate flat.

Figure 1:
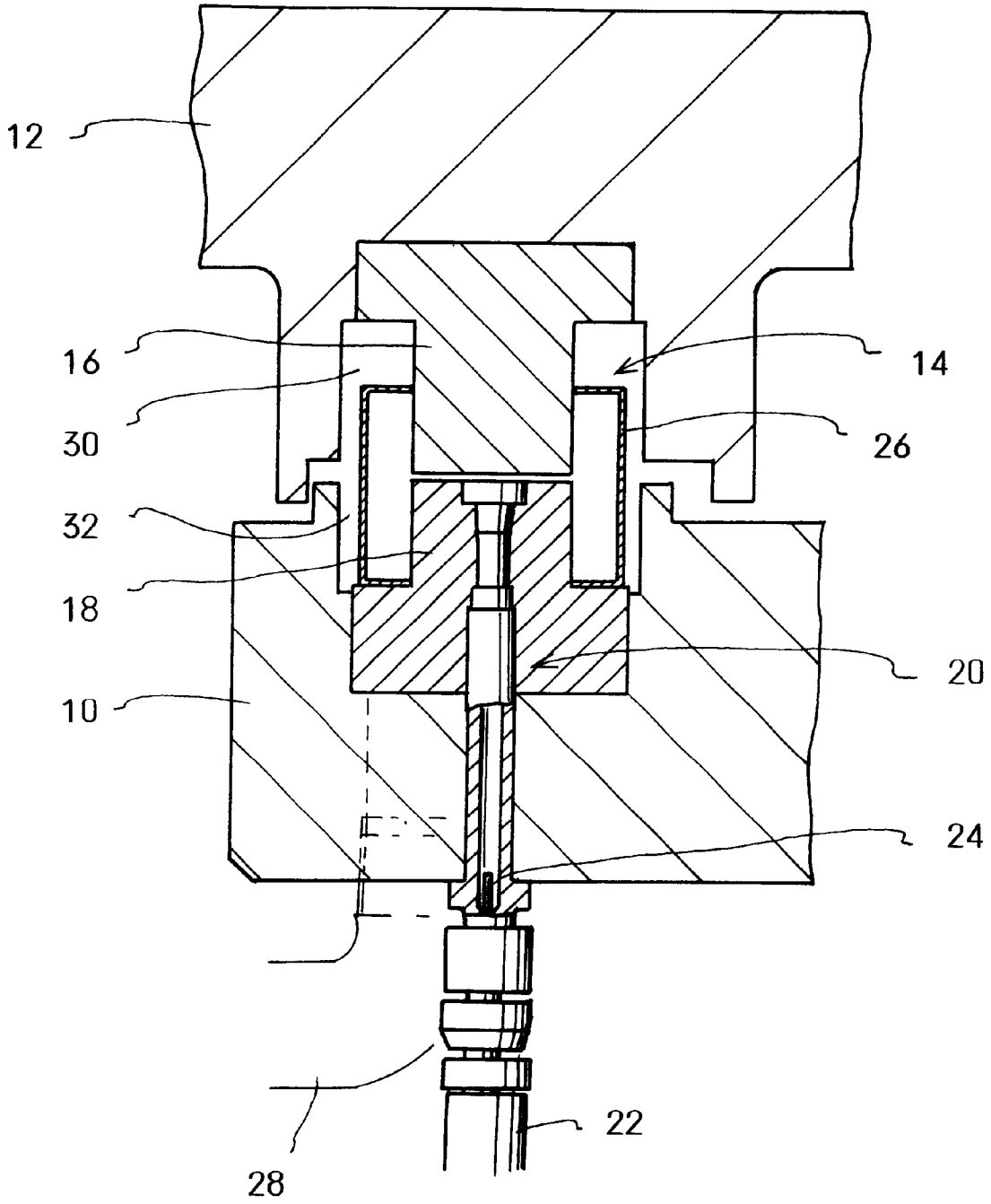
FIG. 1 is a partial sectional view of an example of a fluid bearing of a polishing machine of the present invention.
Figure 9:
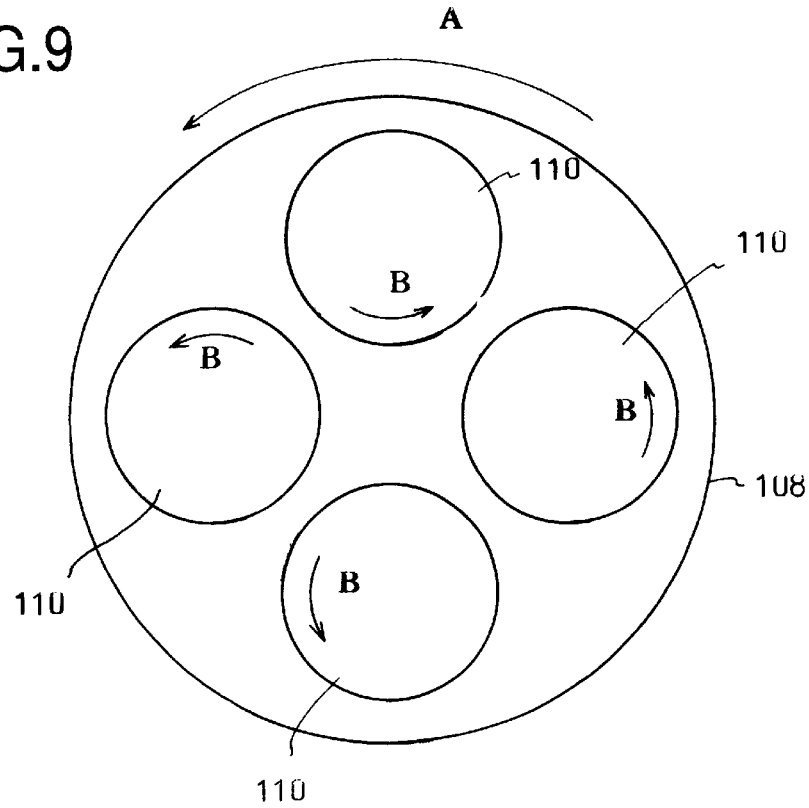
FIG. 9 is an explanation view of the conventional polishing machine.
Figure 10:
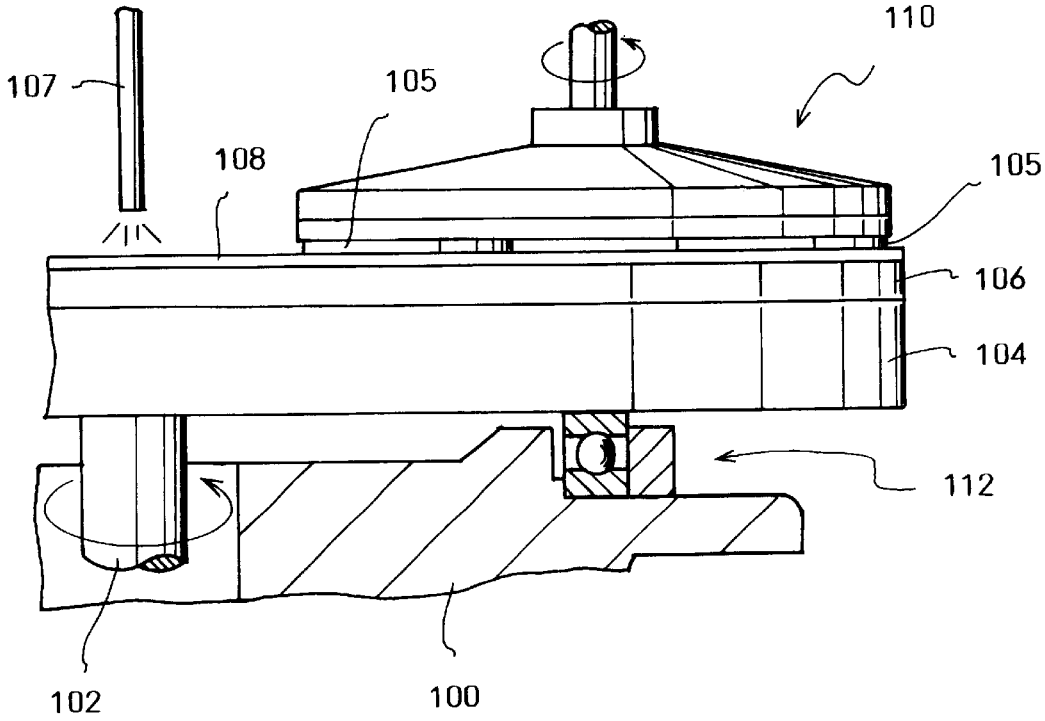
FIG.10 PRIOR ART
FIG. 10 is a partial sectional view of the bearing of the conventional polishing machine.

A static fluid bearing can be used as the fluid bearing. An example of the static fluid bearing is shown in FIG. 1. In a polishing machine shown in FIG. 1, the static fluid bearing 14 is provided between a base 10 and a plate holder 12. The static fluid bearing 14 is located in the vicinity of outer edges of the base 10 and the plate holder 12, to which pressing force of a press unit (see FIGS. 9 and 10), etc. will be applied.

The static fluid bearing 14 includes: an upper projection 16 fixed to the plate holder 12 and projected toward the base 10, a lower end face of the upper projection 16 being formed into a flat face; and a lower projection 18 fixed to the base 10 and projected toward the plate holder 12, an upper end face of the lower projection 18 being formed into a flat face and faced to the lower end face of the upper projection 16. An orifices of jet nozzle 20, which jets out oil toward the lower end face of the upper projection 16, is opened in the upper end face of the lower projection 18.

The jet nozzle 20 shown in FIG. 1 is connected to an oil pump (not shown) by a rubber hose 22. Speed of running oil is increased at a throttling section 24, then the oil is jetted out, from the orifice, toward the lower end face of the upper projection 16. By jetting out the oil, the upper projection 16 is lifted from the upper end face of the lower projection 18, so that the plate holder 12 and a polishing plate can be rotatably supported.

The oil, which has been jetted out toward the lower end face of the upper projection 16, runs through a space between the upper projection 16 and the lower projection 18 and covers the end faces of the both projections 16 and 18. Then the oil is collected by a seal ring 26, which covers the both projections 16 and 18. The oil collected in the seal ring 26 is returned to an oil tank (not shown) via an oil discharging port (not shown) of the seal ring 26 and a discharging hose 28.

The static fluid bearing 14 is provided in a groove 30 of the plate holder 12 and a groove 32, which is formed in the base 10 and faced to the groove 30. A crank-shaped or a labyrinth-shaped space is formed between a lower end section of the groove 30 and an upper end section of the groove 32. By forming the crank-shaped space, no dusts and slurry invade into the static fluid bearing 14.

Figure 2:
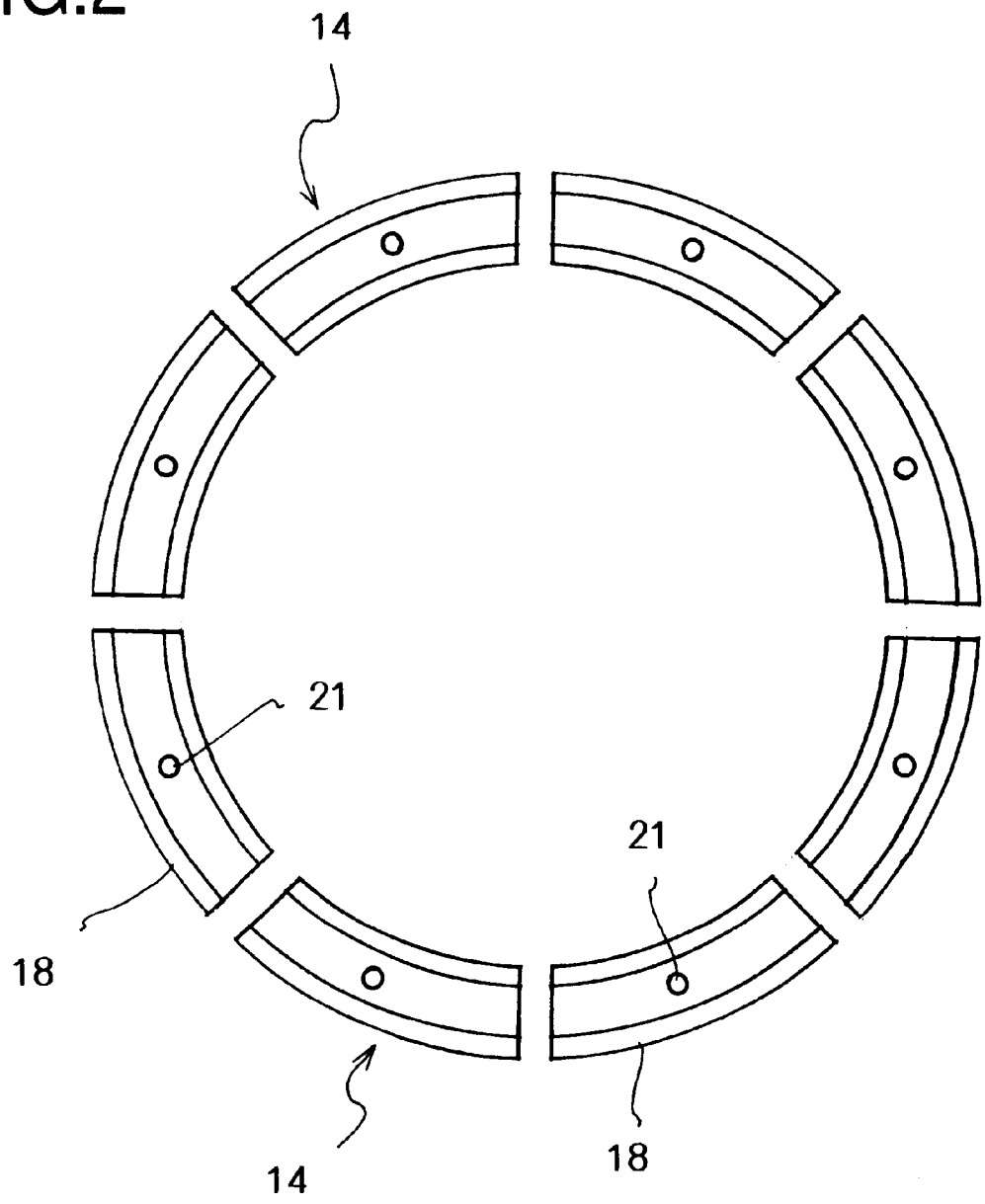
FIG. 2 is a front view of a lower projection of the fluid bearing shown in Fig. 1.
Figure 3A:
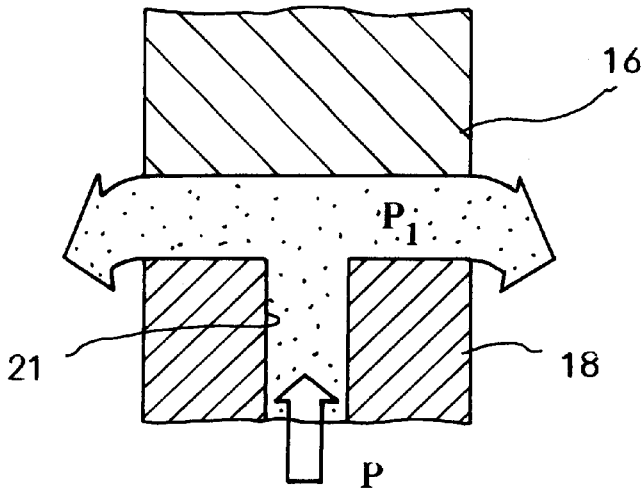
FIGS. 3A–3C are explanation views explaining action of the static fluid bearing shown in FIG. 1.

Preferably, as shown in FIG. 2, a plurality of the static fluid bearings 14 shown in FIG. 3A are circularly arranged along the outer edge of the plate holder 12. By providing a plurality of the bearings 14, the table-shaped plate holder 12, which holds the polishing plate, can be support horizontally as much as possible, and a polishing face of the polishing plate can be kept flat as much as possible.

In FIG. 2, a plurality of the lower projections 16 of the static fluid bearing 14 are circularly arranged along the outer edge of the plate holder 12. The orifice 21 of the jet nozzle 20 is opened at a center of the upper end face of each lower projection 18; the upper projections 16 of the plate holder 12 are respectively provided above the upper end faces of the lower projections 18.

In the polishing machine having the static fluid bearing 14 shown in FIGS. 1 and 2, as shown in FIG. 3A, the oil, which has been pressurized with pressure P, is jetted out from the orifice 21 of the jet nozzle 20, which is opened in the upper end face of the lower projection 18, with pressure $P_1$, toward the lower end face of the upper projection 16 of the plate holder 12, so that the upper projection 16 can be lifted from the upper end face of the lower projection 18 and supported.

If pressing force applied to the plate holder 12 is fixed, the pressure $P_1$, which upwardly lifts the upper projection 16, is determined on the basis of the gaps or the spaces between the both projections 16 and 18.

Figure 3B:
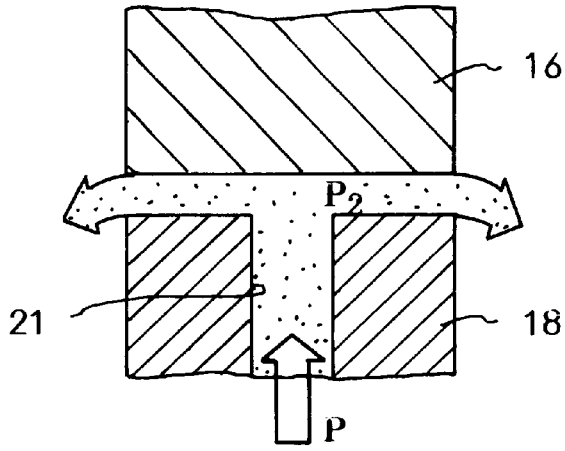

In FIG. 3B, the gap between the end faces of the both projections 16 and 18 is made narrower than that shown in FIG. 3A by vibrations of the plate holder 12, etc. In this case, pressure $P_2$ for lifting the upper projection 16 is made greater than the pressure $P_1$. Thus, the plate holder 12 is immediately moved upward and a length of said gap is returned to an initial length shown in FIG. 3A.

Figure 3C:
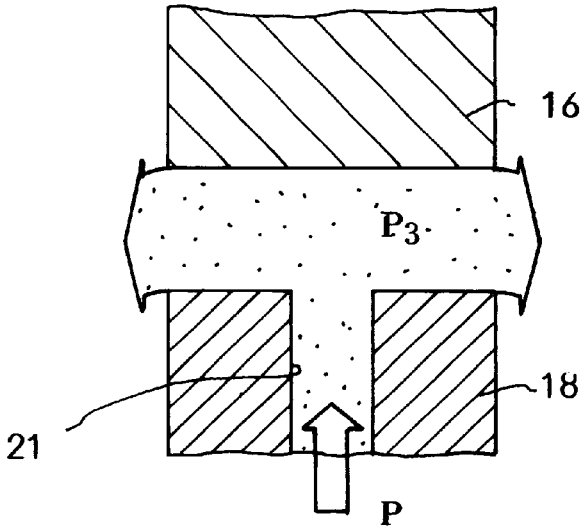

On the other hand, in FIG. 3C, the gap between the end faces of the both projections 16 and 18 is made wider than that shown in FIG. 3A by vibrations of the plate holder 12, etc. In this case, pressure $P_3$ for lifting the upper projection 16 is made lower than the pressure $P_1$. Thus, the plate holder 12 is immediately moved downward and the length of said gap is returned to the initial length shown in FIG. 3A.

The static fluid bearing 14 shown in FIG. 1 can absorb the vibrations of the plate holder 12 and keep the plate holder 12 at a prescribed height. Thus, the plate holder 12 can be supported by the static fluid bearing 14 as well as the ball bearing, which has true sphere balls with no errors, and no vibrations occurred due to no balls. When work pieces, e.g., silicon wafers, are polished by the polishing machine having the static fluid bearing 14, forming the ripple-shaped fine projections on surfaces of the polished work pieces can be prevented.

In the static fluid bearing 14 shown in FIGS. 1 and 2, the oil is jetted out from the orifices 21 while rotating the plate holder 12. Further, in the present embodiment, the oil is jetted out while stopping the plate holder 12, so the plate holder 12 can be supported, by the oil, while stopping. Therefore, rotational speed of the plate holder 12 can be quickly accelerated when the plate holder 12 is restarted.

By maintaining the oil pressure applied to the nozzles 20 at a fixed value, the gap between the end faces of the both projections 16 and 18 can be maintained the prescribed length, so that a vertical position or height of the polishing face of the polishing plate can be fixed at a predetermined position or height. Thus, the pressing force of the press units 110 (see FIGS. 9 and 10), which are applied to the work pieces, can be fixed, so that flatness of the polished surfaces of the work pieces can be further improved.

Figure 4:
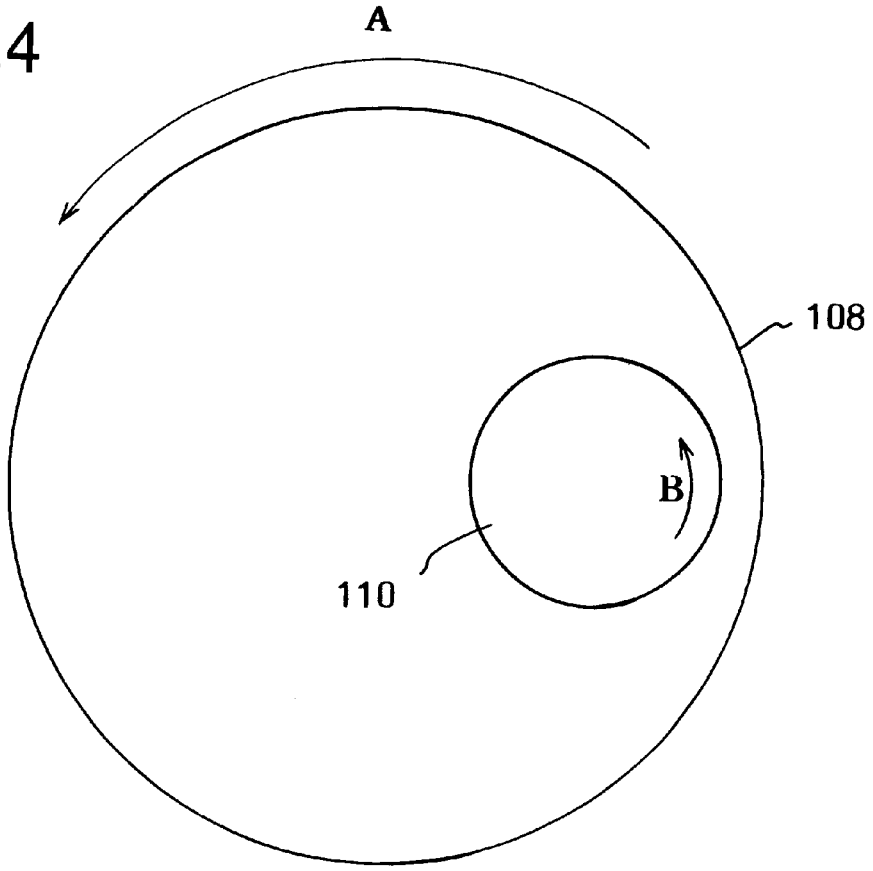
FIG. 4 is an explanation view of another embodiment of the polishing machine of the present invention.

In another embodiment shown in FIG. 4, one work piece, e.g., a silicon wafer, is polished by a polishing cloth 108, which is fixed on the polishing plate rotating in a direction of an arrow A. In the polishing machine shown in FIG. 4, the polishing cloth 108 is fixed on a surface of the polishing plate rotating in the direction of the arrow A, and one press unit 110, which is provided in the vicinity of an outer edge of the polishing cloth 108 is rotated in a direction of an arrow B. The press unit 110 presses the work piece onto the polishing cloth 108 so as to polish the surface of the work piece like a mirror face.

In the embodiment shown in FIG. 4, the press unit 110 is provided in the vicinity of the outer edge of the polishing cloth 108, the press unit 110 partially presses the plate holder 12, which supports the polishing cloth 108 and the polishing plate.

Figure 5:
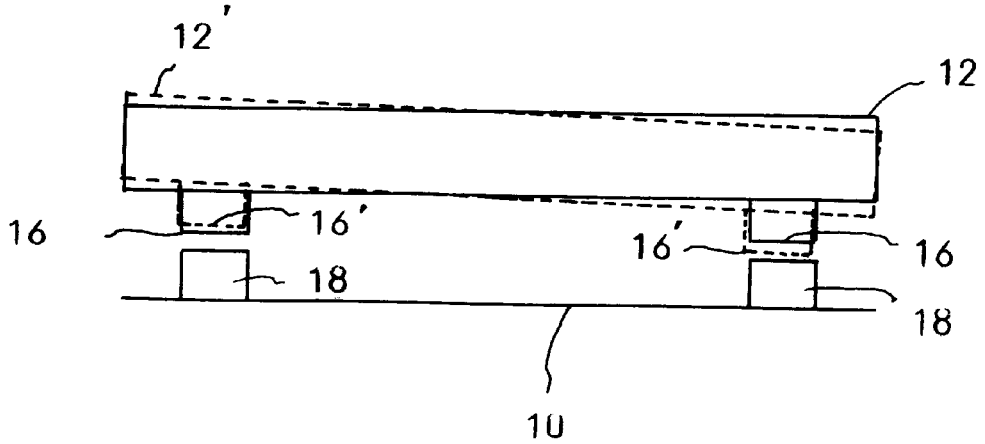
FIG. 5 is an explanation view of a plate holder of the polishing machine shown in FIG. 4.

As shown in FIG. 5, by partially pressing, the length of the gap between the upper projection 16', which is provided to a lower part of the plate holder 12' which is inclined by the pressing force of the press unit 110, and the lower projection 18 of the base 10 is made narrower than that shown in FIG. 3A as well as the state shown in FIG. 3B. Thus, the pressure $P_2$ (see FIG. 3B) for lifting the upper projection 16' is made greater than the pressure $P_1$ shown in FIG. 3A, so that the upper projection 16' is moved upward until reaching the initial level shown in FIG. 3A.

On the other hand, the length of the gap between the upper projection 16', which is provided to a higher part of the plate holder 12' which is inclined by the pressing force of the press unit 110, and the lower projection 18 of the base 10 is made wider than that shown in FIG. 3A as well as the state shown in FIG. 3C. Thus, the pressure $P_3$ (see FIG. 3C) for lifting the upper projection 16' is made lower than the pressure $P_1$ shown in FIG. 3A, so that the upper projection 16' is moved downward until reaching the initial level shown in FIG. 3A.

Even if the pressing force is partially applied to the plate holder 12, the plate holder 12 can be horizontally supported by the static fluid bearing 14, so that the polishing face of the polishing plate can be kept flat as much as possible.

Figure 6:
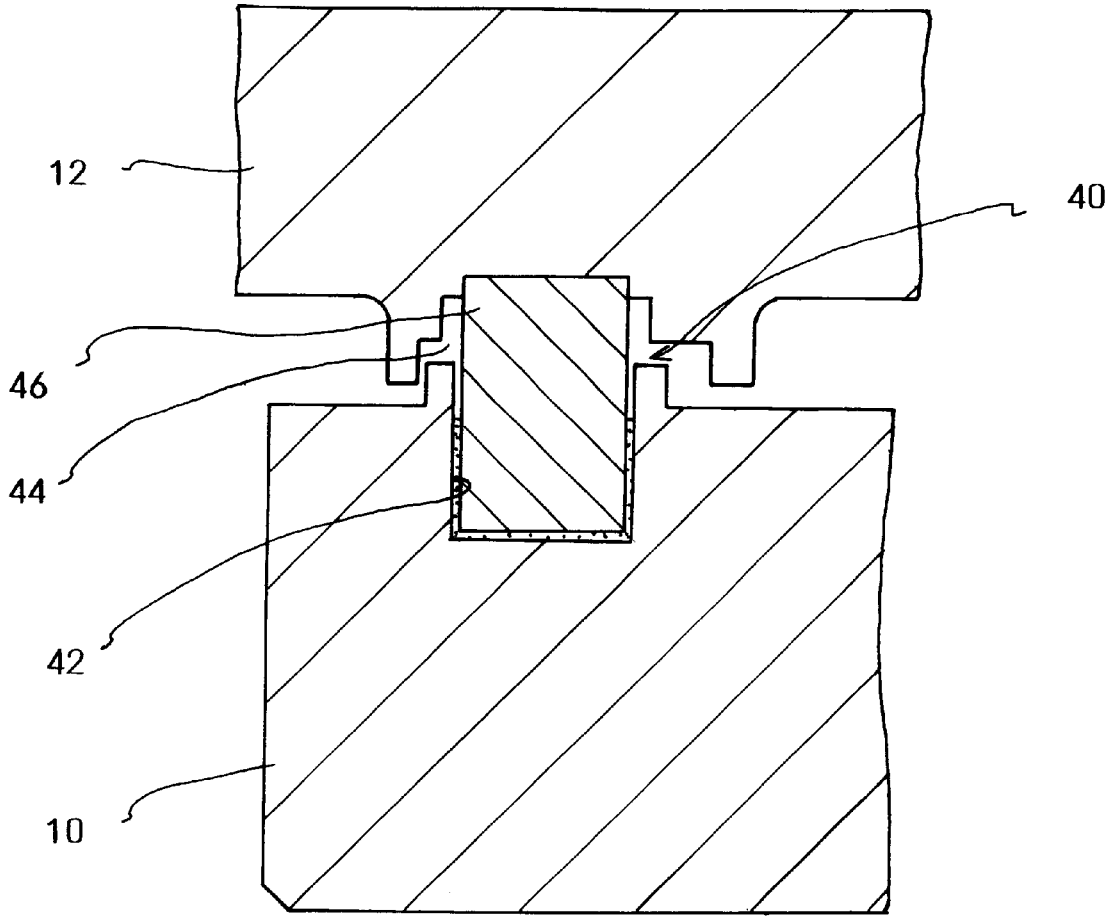
FIG. 6 is a partial sectional view of another fluid bearing.
Figure 7:
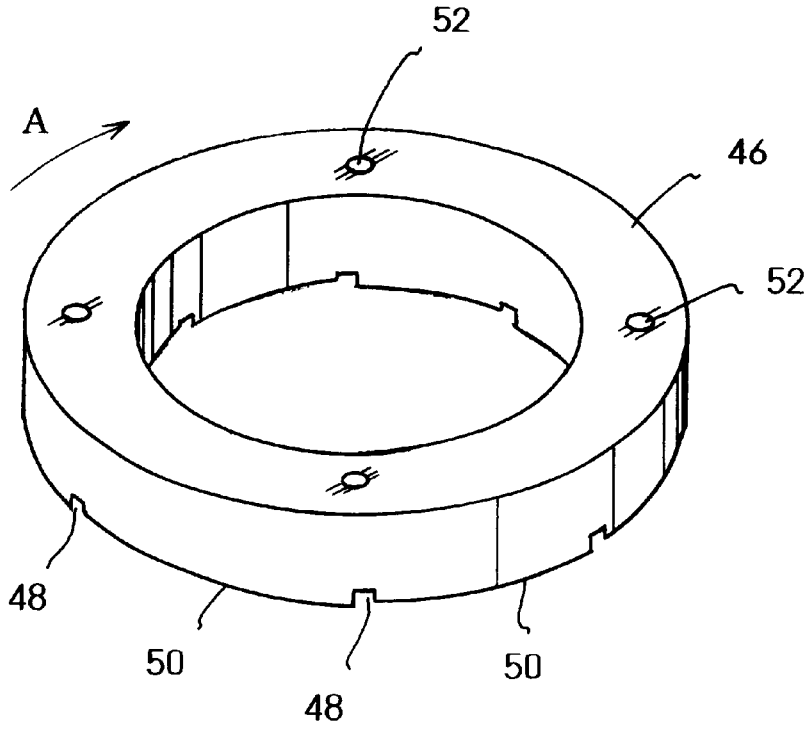
FIG. 7 is a perspective view of a circular projection of the dynamic fluid bearing shown in FIG. 6.
Figure 8:
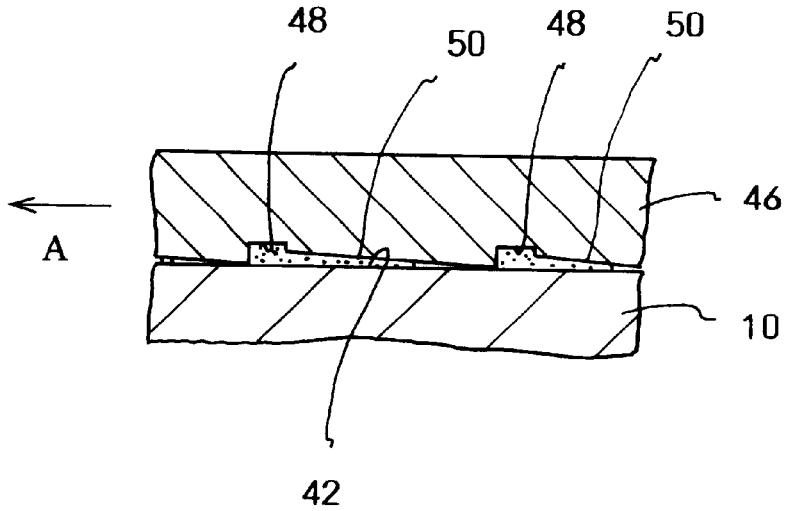
FIG. 8 is a partial sectional view showing action of the dynamic fluid bearing.

In the static fluid bearing 14 shown in FIGS. 1 and 2, the oil pump for pressurizing the oil supplied to the jet nozzles 20 is required. In the case shown in FIG. 9 in which the pressing force of the press units can be uniformly applied to the plate holder 12, the oil pump is not required. Another embodiment shown in FIG. 6 includes a dynamic fluid bearing 40, which has a simple structure with no oil pump. The dynamic fluid bearing 40 is provided in the vicinity of the outer edges of the base 10 and the plate holder 12 to which the pressing force of the press units 110 and the weight of the polishing plate are applied. As shown in FIG. 6, the dynamic fluid bearing 40 includes: a circular groove 42 being formed in the base 10 and capable of holding the fluid (oil), and having a flat inner bottom face; and a circular projection 46 being downwardly projected from a circular groove 44 of the plate holder 12 and having a lower end section being inserted in the circular groove 42. As shown in FIG. 7, the circular projection 46 of the dynamic fluid bearing 14 has a plurality of notches 48, and a slope face 50 is formed between the adjacent notches 48 as shown in FIG. 8.

Each of the slope faces 50 is inclined in a direction opposite to a rotational direction (an arrow A). Wedge-shaped spaces are formed between the slope faces 50 and the flat inner bottom face of the circular groove 42 of the base 10. The angle of the slope faces 50 depends on viscosity, etc. of the fluid, it is 2–3° in the present embodiment.

Holes 52 formed in the upper end face of the circular projection 46 are used when the circular projection 46 is fixed on the plate holder 12.

A crank-shaped space or a labyrinth-shaped space is formed between a front end section of the circular groove 42 of the base 10 and a front end section of the circular groove 44 of the plate holder 12 as shown in FIG. 6, so that no dusts and no slurry can invade into the dynamic fluid bearing 40.

The dynamic fluid bearing 40 shown in FIGS. 6–8 contacts the inner bottom face of the circular groove 42 with the oil layer when the plate holder 12 is stopped.

On the other hand, when the plate holder 12 is rotated in the direction of the arrow A, the oil stuck on the slope faces 50 of the front end face of the circular projection 46 is drawn, by the wedge-shaped spaces, which are formed between the slope faces 50 and the flat inner bottom face of the circular groove 42, in the opposite direction to the rotational direction (the arrow A) of the plate holder 12, so that pressure (dynamic pressure) for lifting the circular projection from the inner bottom face of the circular groove 42 is generated in the wedge-shaped spaces. The dynamic pressure lifts the plate holder 12 upward, so that the plate holder 12 can be rotated with a predetermined separation from the base 10. Thus, the plate holder 12 can be supported by the dynamic fluid bearing 40 as well as the ball bearing, which has true sphere balls with no errors, and no vibrations occurred due to no balls. When work pieces, e.g., silicon wafers, are polished by the polishing machine having the dynamic fluid bearing 40, forming the ripple-shaped fine projections on surfaces of the polished work pieces can be prevented.

By accelerating the rotational speed of the plate holder 12, the dynamic pressure of the dynamic fluid bearing 40 is made higher and stability is increased, but the vertical level or height of the polishing face is varied on the basis of the rotational speed of the plate holder 12. To solve this disadvantage, in the present embodiment, the press units 110 (see FIGS. 9 and 10) is downwardly moved to the polishing face, so as to start polishing, after the rotational speed of the plate holder 12 reaches a prescribed speed. In this case, preferably the rotational speed of the plate holder 12 is determined by considering amount of a downward movement of the plate holder 12, which is caused by the pressing force of the press units 110.

Since the end face of the circular projection 46 contacts the inner bottom face of the circular groove 42 with the oil layer when the plate holder 12 is stopped, the rotational speed of the plate holder 12 should be gradually accelerated when the plate holder 12 is restarted.

In the present invention, the plate holder can be supported by the fluid bearing as well as the ball bearing, which has true sphere balls with no errors, and no vibrations occurred due to no balls. When the work pieces are polished, forming the ripple-shaped fine projections on surfaces of the polished work pieces can be prevented. Therefore, silicon wafers, etc., which must be polished highly flat, can be polished by the polishing machine of the present invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A polishing machine, comprising:

a plate holder being rotatably provided to a base;

a polishing plate being mounted on said plate holder, an upper face of said polishing plate being covered with a polishing cloth as a polishing face; and a press unit for pressing a surface of a work piece onto the polishing face of said polishing plate so as to polish the surface of the work piece like a mirror face, characterized by, a fluid bearing rotatably supporting said plate holder by fluid pressure, at a position between said plate holder and said base, so as to keep the polishing face of said polishing plate flat.

2. The polishing machine according to claim 1, wherein said fluid bearing is a static fluid bearing, which rotatably supports said plate holder by the pressure of the fluid, which is jetted from a plurality of jet nozzles formed in said base.

3. The polishing machine according to claim 2, wherein orifices of said jet nozzles are opened and arranged along a circumferential edge of said plate holder.

4. The polishing machine according to claim 2, wherein said static fluid bearing includes:

an upper projection being formed along a circumferential edge of said plate holder and projected toward said base, a lower end face of said upper projection being formed into a flat face; and a lower projection being formed in said base and projected toward said plate holder, an upper end face of said lower projection being formed into a flat face and faced to the lower end face of said upper projection, and the orifices of said jet nozzles are opened in the upper end face of said lower projection.

5. The polishing machine according to claim 4, further comprising a seal section being formed along said upper projection and said lower projection so as to cover a space between the lower end face of said upper projection and the upper end face of said lower projection, said seal section being capable of collecting the fluid, which has been jetted out from said jet nozzles of said lower projection toward said upper projection, and discharging the collected fluid from a portion in the vicinity of said upper projection and said lower projection.

6. The polishing machine according to claim 4, wherein said upper projection is formed in an upper groove, which is formed in said plate holder and opened in a direction of said base, said lower projection is formed in a lower groove, which is formed in said base and opened in a direction of said upper groove, and a labyrinth-shaped space is formed between a lower end section of said upper groove and an upper end section of said lower groove.

7. The polishing machine according to claim 1, wherein said fluid bearing is a dynamic fluid bearing including:

a circular groove being formed in said base, said circular groove holding the fluid, an inner bottom face of said circular groove being formed into a flat face; and a circular projection being downwardly projected from said plate holder, a lower end section of said circular projection being inserted in said circular groove, whereby dynamic pressure for rotatably supporting said plate holder is applied to the lower end section of said circular projection when said plate holder is rotated.

8. The polishing machine according to claim 7, wherein said circular groove of said base is formed along a circumferential edge of said plate holder, and said circular projection, which is inserted in said circular groove, is formed in the vicinity of the circumferential edge of said plate holder.

9. The polishing machine according to claim 7, wherein a plurality of notches are formed in the lower end face of said circular projection, and a slope face, which is inclined in a direction opposite to a rotational direction of said circular projection, is extended from each of said notches.

10. The polishing machine according to claim 7, wherein an upper circular groove is formed in said plate holder and opened in a direction of said base, a circular projection is formed in said upper circular groove, a lower circular groove is formed in said base and opened in a direction of said upper circular groove, and a labyrinth-shaped space is formed between a lower end section of said upper groove and an upper end section of said lower groove when the lower end section of said circular projection is inserted in said lower circular groove.

* * * * *